US009821199B1

(12) United States Patent
Seluga et al.

(10) Patent No.: US 9,821,199 B1
(45) **Date of Patent: *Nov. 21, 2017**

(54) GOLF CLUB HEAD HAVING STRESS-REDUCING TUBES

(71) Applicant: Callaway Golf Company, Carlsbad, CA (US)

(72) Inventors: James A. Seluga, Carlsbad, CA (US); Matthew Myers, Carlsbad, CA (US); Bradley C. Rice, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/063,107

(22) Filed: Mar. 7, 2016

Related U.S. Application Data

(63) Continuation-in-part of application No. 14/997,199, filed on Jan. 15, 2016, which is a continuation-in-part of application No. 14/788,326, filed on Jun. 30, 2015, now Pat. No. 9,597,558, and a continuation-in-part of application No. 14/794,578, filed on Jul. 8, 2015, now Pat. No. 9,814,947, and a continuation-in-part of application No. 14/622,606, filed on Feb. 13, 2015, now Pat. No. 9,345,936, which is a continuation of application No. 13/906,572, filed on May 31, 2013, now Pat. No. 8,956,244, said application No. 14/794,578 is a continuation-in-part of application (Continued)

(51) Int. Cl.

| | |
|---|---|
| ***A63B 53/06*** | (2015.01) |
| ***A63B 53/04*** | (2015.01) |
| ***B21D 39/06*** | (2006.01) |
| ***B23K 31/02*** | (2006.01) |

(52) U.S. Cl.
CPC ..... *A63B 53/0466* (2013.01); *B21D 39/06* (2013.01); *B23K 31/02* (2013.01); *A63B 2053/0454* (2013.01)

(58) Field of Classification Search
CPC .. A63B 53/04; A63B 53/06; A63B 2053/0791
USPC ..... 473/324, 329, 330, 334, 340, 342
See application file for complete search history.

(56) References Cited

U.S. PATENT DOCUMENTS 3,437,133 A * 4/1969 Bullard ..... F28D 7/06 165/149
3,608,173 A * 9/1971 Watson ..... B21D 39/06 228/125

(Continued)

FOREIGN PATENT DOCUMENTS

JP 3821516 9/2006

*Primary Examiner* — William Pierce
(74) *Attorney, Agent, or Firm* — Rebecca Hanovice; Michael Catania; Sonia Lari

(57) ABSTRACT

A golf club head comprising a body and a plurality of metal tubes is disclosed herein. The body comprises a face section, a sole section, and a return section, and also defines a hollow interior. Each of the plurality of metal tubes extends from the return section to the sole section to reduce stresses placed on the face during impact with a golf ball. The body and the metal tubes preferably are composed of a titanium alloy or stainless steel. After the metal tubes are inserted into apertures in the return section and the sole section of the body, each metal tube is mechanically attached to the body using a tool that causes the ends of each metal tube to flare outwards.

13 Claims, 4 Drawing Sheets

Related U.S. Application Data

No. 14/755,068, filed on Jun. 30, 2015, now Pat. No. 9,623,302, which is a continuation-in-part of application No. 14/498,843, filed on Sep. 26, 2014, now Pat. No. 9,259,627, which is a continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 61/665,203, filed on Jun. 27, 2012, provisional application No. 61/684,079, filed on Aug. 16, 2012.

(56) References Cited

U.S. PATENT DOCUMENTS

| | | | | |
|---|---|---|---|---|
| 3,652,094 | A | 3/1972 | Glover | |
| 4,334,703 | A * | 6/1982 | Arthur | B21D 39/04 181/272 |
| 4,606,491 | A * | 8/1986 | Le Mong | B23K 9/0288 228/119 |
| 5,489,097 | A | 2/1996 | Simmons | |
| 5,766,094 | A | 6/1998 | Mahaffey et al. | |
| 6,149,533 | A | 11/2000 | Finn | |
| 6,383,090 | B1 | 5/2002 | O'Doherty et al. | |
| 6,852,038 | B2 | 2/2005 | Yabu | |
| 6,923,734 | B2 | 8/2005 | Meyer | |
| 6,979,270 | B1 | 12/2005 | Allen | |
| 7,108,609 | B2 | 9/2006 | Stites et al. | |
| 7,118,493 | B2 | 10/2006 | Galloway | |
| 7,351,161 | B2 | 4/2008 | Beach | |
| 7,387,579 | B2 | 6/2008 | Lin et al. | |
| 7,691,006 | B1 | 4/2010 | Burke | |
| 7,775,905 | B2 | 8/2010 | Beach et al. | |
| 7,914,393 | B2 | 3/2011 | Hirsch et al. | |
| 7,927,231 | B2 | 4/2011 | Sato et al. | |
| 8,147,354 | B2 * | 4/2012 | Hartwell | A63B 53/0466 473/344 |
| 8,523,702 | B2 | 9/2013 | Thomas et al. | |
| 8,540,587 | B2 | 9/2013 | Hirsch et al. | |
| 8,591,352 | B2 | 11/2013 | Hirano | |
| 8,608,585 | B2 | 12/2013 | Stites et al. | |
| 8,663,027 | B2 | 3/2014 | Morales et al. | |
| 8,834,293 | B2 | 9/2014 | Thomas et al. | |
| 8,834,294 | B1 | 9/2014 | Seluga et al. | |
| 2010/0273565 | A1 | 10/2010 | Stites et al. | |
| 2010/0304887 | A1 | 12/2010 | Bennett et al. | |
| 2011/0039634 | A1 | 2/2011 | Tavares et al. | |
| 2011/0152001 | A1 | 6/2011 | Hirano | |
| 2011/0172027 | A1 | 7/2011 | Hirsch et al. | |
| 2011/0224017 | A1 | 9/2011 | Thomas et al. | |
| 2012/0094780 | A1 | 4/2012 | Slaughter et al. | |
| 2012/0165115 | A1 | 6/2012 | Matsunaga | |
| 2012/0302367 | A1 | 11/2012 | Myrhum et al. | |
| 2013/0102410 | A1 | 4/2013 | Stites et al. | |
| 2013/0130829 | A1 | 5/2013 | Bennett et al. | |
| 2013/0130834 | A1 | 5/2013 | Stites et al. | |
| 2013/0184099 | A1 | 7/2013 | Stites et al. | |
| 2013/0324299 | A1 | 12/2013 | Clausen et al. | |
| 2015/0165280 | A1 | 6/2015 | Hebreo | |

* cited by examiner

GOLF CLUB HEAD HAVING STRESS-REDUCING TUBES

CROSS REFERENCES TO RELATED APPLICATIONS

The present invention is a continuation-in-part of U.S. patent application Ser. No. 14/997,199, filed on Jan. 15, 2016, which is a continuation-in-part of U.S. patent application Ser. No. 14/788,326, filed on Jun. 30, 2015, and is also a continuation-in-part of U.S. patent application Ser. No. 14/794,578, filed on Jul. 8, 2015, both of which are continuations-in-part of U.S. patent application Ser. No. 14/755,068, filed on Jun. 30, 2015, which is a continuation-in-part of U.S. patent application Ser. No. 14/498,843, filed on Sep. 26, 2014, and issued on Feb. 16, 2016, as U.S. Pat. No. 9,259,627, which is a continuation-in-part of U.S. patent application Ser. No. 14/173,615, filed on Feb. 5, 2014, and issued on Nov. 10, 2015, as U.S. Pat. No. 9,180,349, which claims priority to U.S. Provisional Patent Application No. 61/898,956, filed on Nov. 1, 2013, and which is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, now abandoned, which claims priority to U.S. Provisional Patent Application Nos. 61/665,203, filed on Jun. 27, 2012, and 61/684,079, filed on Aug. 16, 2012. The present application is also a continuation-in-part of U.S. patent application Ser. No. 14/622,606, filed on Feb. 13, 2015, and issued on May 24, 2016, as U.S. Pat. No. 9,345,936, which is a continuation of U.S. patent application Ser. No. 13/906,572, filed on May 31, 2013, and issued on Feb. 17, 2015, as U.S. Pat. No. 8,956,244, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with stress-reducing tubes disposed proximate a striking face and methods of manufacturing the golf club head.

Description of the Related Art

The prior art discloses various golf club heads having interior structures and methods of making such structures. For example, Yabu, U.S. Pat. No. 6,852,038 for a Golf Club Head And Method OF Making The Same, discloses a golf club head with a sound bar and a method of casting said sound bar, Galloway, U.S. Pat. No. 7,118,493 for a Multiple Material Golf Club Head discloses a golf club head with a composite aft body having an interior sound component extending upward from a sole section of a metal face component, Seluga et al., U.S. Pat. No. 8,834,294 for a Golf Club Head With Center Of Gravity Adjustability discloses a golf club head with a tube having a mass for adjusting the CG of a golf club head, and Dawson et al., U.S. Pat. No. 8,900,070 for a Weighted Golf Club Head discloses a golf club head with an interior weight lip extending from the sole towards the face. However, the prior art fails to disclose an interior structure that increases ball speed through reducing stress in the face at impact, with a minimal increase in mass to the golf club head, and that is manufactured quickly and at a low cost.

BRIEF SUMMARY OF THE INVENTION

The golf club head comprises interior metal tubes to reduce the stress in a face during impact with a golf ball. In some embodiments, the tubes are composed of a titanium alloy.

One aspect of the present invention is a golf club head comprising a body and a plurality of metal tubes. The body comprises a face section, a sole section and a return section.

The body defines a hollow interior. Each of the plurality of metal tubes extends from the return section to the sole section.

Another aspect of the present invention is a method of installing metal tubes in a golf club head having apertures in top and bottom surfaces comprising inserting the tubes into the apertures and then flaring their ends outwards to mechanically lock them to the club head.

Yet another aspect of the present invention is a golf club head comprising a body comprising a face section, a sole section, and a return section, the body defining a hollow interior, and a plurality of metal tubes, each of the plurality of metal tubes extending from the return section to the sole section, wherein the return section comprises a first plurality of apertures, wherein the sole section comprises a second plurality of apertures, wherein each of the first plurality of apertures corresponds to a metal tube of the plurality of metal tubes, wherein each of the second plurality of apertures corresponds to a metal tube of the plurality of metal tubes, and wherein at least one of the metal tubes of the plurality of metal tubes is mechanically attached to the body. In some embodiments, each of the plurality of metal tubes may be mechanically attached to the body, and in further embodiments each of the plurality of metal tubes may have an upper end and a lower end, each of which may comprise a flared structure to mechanically lock the metal tubes to the body.

In some embodiments, each of the body and the plurality of metal tubes may be composed of titanium alloy. In other embodiments, each of the plurality of metal tubes may have a diameter ranging from 2 millimeters to 10 millimeters, and at least one of the metal tubes may have a diameter of approximately 6 millimeters. In any of the embodiments, each of the plurality of metal tubes may have a length ranging from 30 millimeters to 60 millimeters, and each of the plurality of metal tubes may be positioned rearward from an interior surface of the face section a distance ranging from 2 millimeters to 11 millimeters. In other embodiments, the golf club head may further comprise a crown section, which may be affixed to the body over an upper opening to enclose the hollow interior. The crown section may be composed of a carbon composite material, and the body may be composed of titanium alloy.

In another embodiment, the plurality of metal tubes may comprise three metal tubes, each of the body and the three metal tubes may be composed of titanium alloy, each of the three metal tubes may have an upper end and a lower end, and each of the upper end and lower end may have a flared structure. In a further embodiment, the golf club head may be selected from the group consisting of a driver-type golf club head and a fairway wood-type golf club head.

Another aspect of the present invention is a method comprising the steps of providing a golf club head body comprising a face section, a hollow interior, an upper opening, a return section comprising at least one upper aperture in communication with the hollow interior, and a sole section comprising at least one lower aperture in communication with the hollow interior, wherein the at least one upper aperture is vertically aligned with the at least one lower aperture, providing at least one metal tube sized to fit within the at least one upper aperture and the at least one lower aperture, wherein the at least one metal tube comprises a longitudinal axis, a first end, and a second end, inserting the at least one metal tube into the hollow interior via one of the at least one upper aperture and the at least one lower aperture so that the first end is disposed within the at least one upper aperture and the second end is disposed within the at least one lower aperture, providing a tool having a flared tip, inserting the flared tip into the first end of the at least one metal tube, pressing the tool towards the hollow interior of the golf club head body along the longitudinal axis so that the first end is forced to flare outwards and removing the flared tip from the first end of the at least one metal tube.

In a further embodiment, the method may comprise the steps of inserting the flared tip into the second end of the at least one metal tube, pressing the tool towards the hollow interior of the golf club head body along the longitudinal axis so that the second end is forced to flare outwards, and removing the flared tip from the second end of the at least one metal tube. In another, further embodiment, the method may comprise the steps of welding the first end of the at least one metal tube to the golf club head body and welding the second end of the at least one metal tube to the golf club head body, wherein the golf club head body may be composed of a metal material.

In yet another embodiment, the method may further comprise the steps of providing a crown section, disposing the crown section over the upper opening of the golf club head body, and permanently affixing the crown section to the golf club head body. If the crown section is composed of a composite material, then the step of permanently affixing the crown section to the golf club head body may comprise bonding the crown section to the golf club head body with an adhesive material. If the crown section and the golf club head body section are each composed of a metal material, then the step of permanently affixing the crown section to the golf club head body may comprise welding the crown section to the golf club head body.

In any of these embodiments, the method may further comprise the step of covering the first end of the at least one metal tube with weld material. In any of these embodiments, the at least one metal tube may comprise first, second, and third metal tubes, the at least one upper aperture may comprise first, second, and third upper apertures, the at least one lower aperture may comprise first, second, and third lower aperture, the first upper aperture may be vertically aligned with the first lower aperture, the second upper aperture may be vertically aligned with the second lower aperture, and the third upper aperture may be vertically aligned with the third lower aperture.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
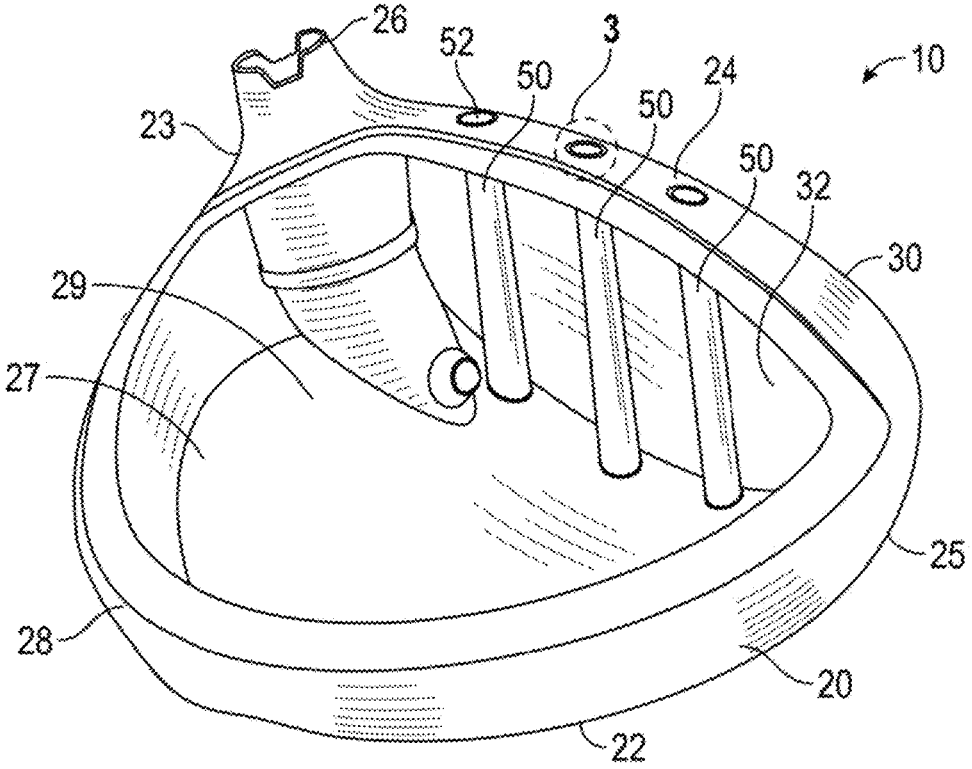
FIG. 1 is a top perspective view of a golf club head of the present invention with a crown section removed to illustrate an interior.
Figure 2:
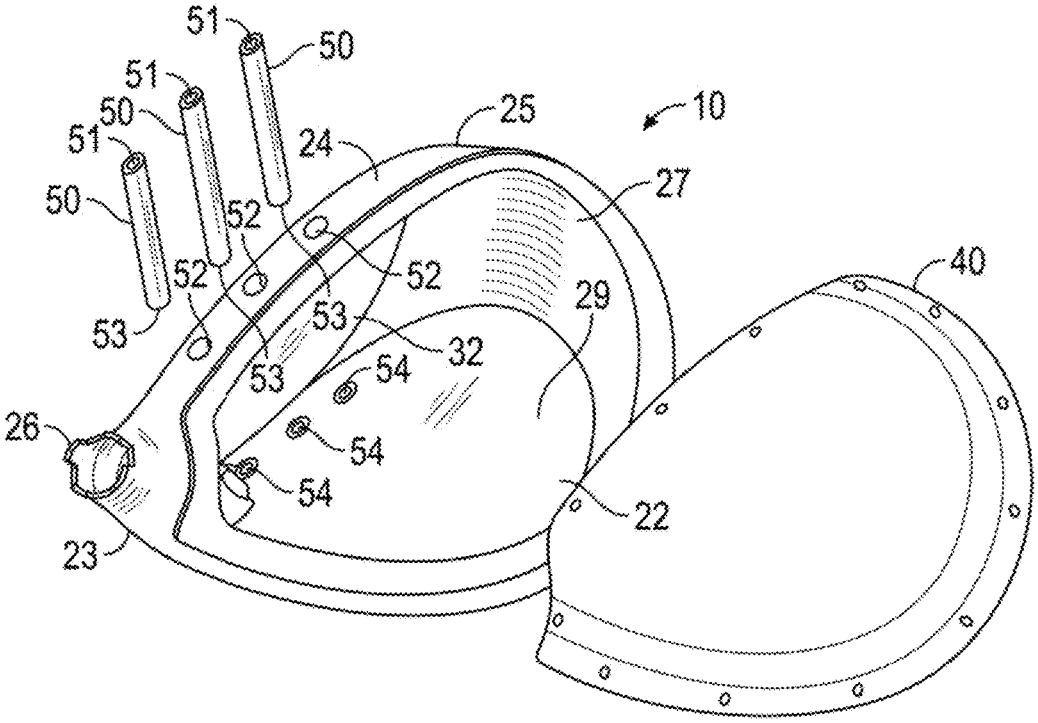
FIG. 2 is a top perspective exploded view of the golf club head shown in FIG. 1.
Figure 3:
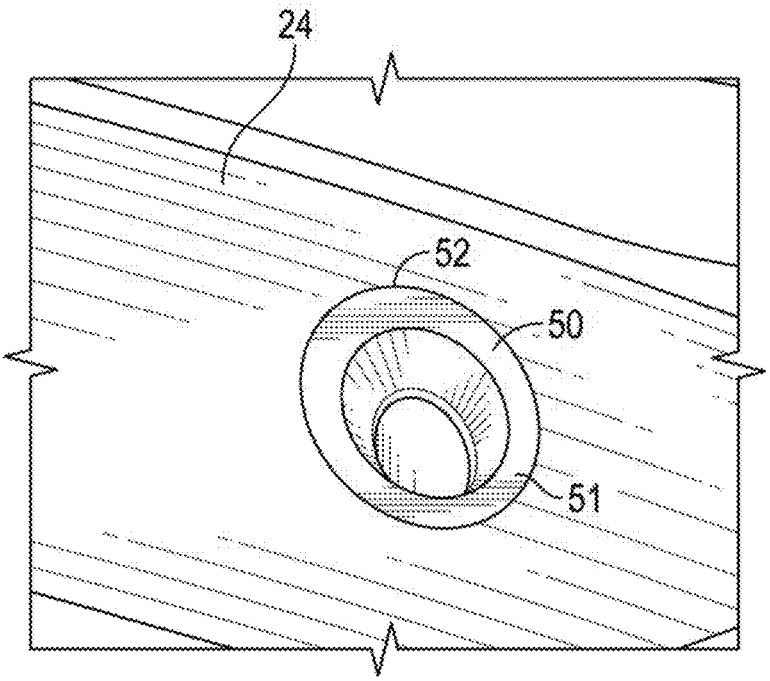
FIG. 3 is an enlarged view of the structure circled in FIG. 1.

A preferred embodiment of the golf club head 10 of the present invention is shown in FIGS. 1-2, and a preferred process of installing metal tubes 50 in the golf club head 10 is shown in FIGS. 3-7. The golf club head 10 includes a body 20 having a sole section 22, a face section 30, a return section 24 extending away from the face section 30, a hosel 26 for engaging a shaft (not shown), a heel end 23, a toe end 25, an upper opening 27, an aft end 28, and a hollow interior 29. A crown section 40 is placed over the upper opening 27 in the body 20 to enclose the hollow interior 29.

Within the hollow interior 29, multiple metal tubes 50 extend from the sole section 22 upward to the return section 24. The metal tubes 50 preferably are composed of a titanium alloy, but in other embodiments may be composed of a steel material. The plurality of metal tubes 50 preferably ranges from two tubes to eight tubes. Each of the plurality of metal tubes 50 preferably has a diameter ranging from 2 millimeters to 10 millimeters, and more preferably approximately 6 millimeters. Each of the plurality of metal tubes 50 preferably has a length ranging from 30 millimeters to 60 millimeters. Each of the plurality of metal tubes 50 is preferably positioned within 11 millimeters of an interior surface 32 of the face section 30.

The return section 24 preferably comprises a plurality of upper apertures 52, each of which preferably corresponds to a metal tube 50 of the plurality of metal tubes 50. The sole section 22 preferably comprises a plurality of lower apertures 54, each of which preferably corresponds to a metal tube 50 of the plurality of metal tubes 50. Each of the plurality of upper apertures 52 is vertically aligned with one of the plurality of lower apertures 54 so that each metal tube 50 can be inserted into the hollow interior 29 of the golf club head 10 in an orientation that is parallel 50 with the interior surface 32 of the face section 30. The metal tubes 50 each are inserted into the hollow interior 29 of the golf club head 10 via one of the pluralities of upper and lower apertures 52, 54. The metal tubes 50 may be cast, formed, machined, forged, or otherwise manufactured separately from one another or cut from a single metal tube.

Figure 4:
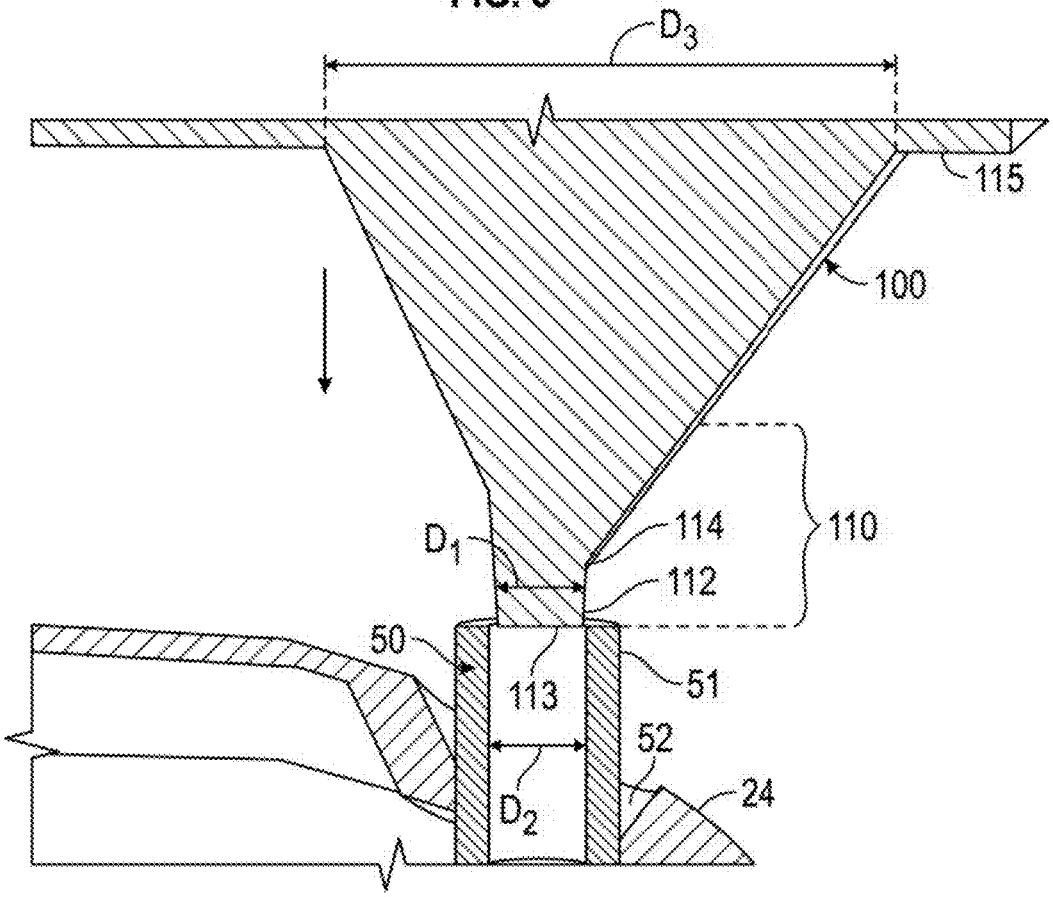
FIG. 4 is a cross-sectional view of the embodiment shown in FIG. 3 during installation of a metal tube.

Once each metal tube 50 is located within the golf club head 10 such that its upper and lower ends 51, 53 are disposed within upper and lower apertures 52, 54, the metal tube 50 is permanently fixed to the golf club head 10 using the process illustrated in FIGS. 4-7. First, as shown in FIG. 4, a tool 100 with a flared end 110 is inserted into the upper or lower end 51, 53 of the metal tube 50. The flared end 110 of the tool 100 has a terminus 112 with a constant diameter $D_1$ that is slightly smaller than the internal diameter $D_2$ of the metal tube 50. The diameter of the flared end 110 changes starting at a transition location 114 spaced from the bottom surface 113, increasing from the diameter $D_1$ of the terminus 112 to a maximum diameter $D_3$ proximate an upper end 115 of the tool 100.

Figure 5:
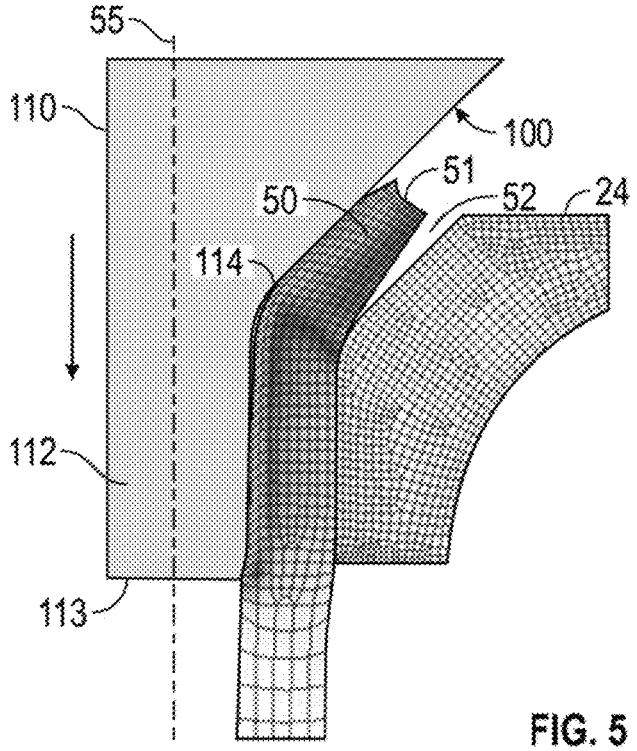
FIG. 5 is an illustration of the pressure placed on the metal tube during installation in the golf club head.
Figure 6:
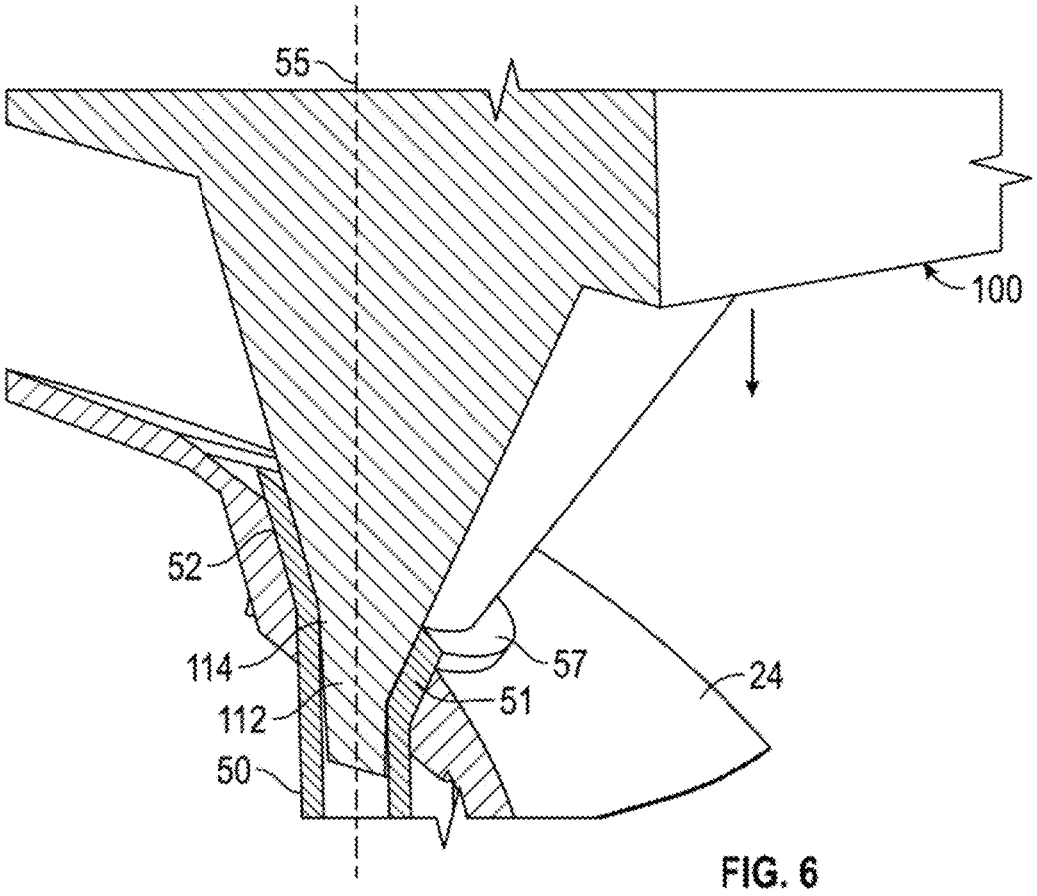
FIG. 6 is another cross-sectional view of the embodiment shown in FIG. 3 during installation of the metal tube.
Figure 7:
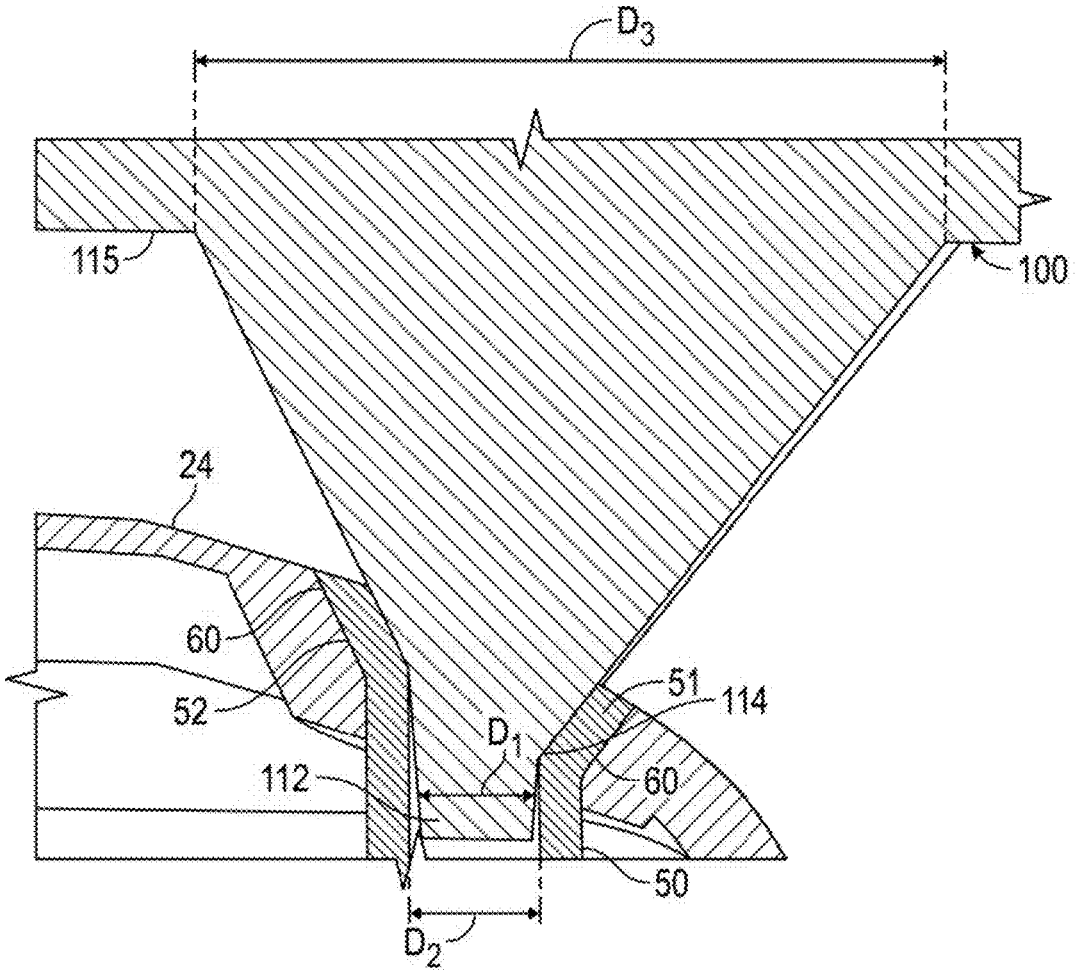
FIG. 7 is a cross-sectional view of the embodiment shown in FIG. 3 when a metal tube is flush with the outer surface of the golf club head.

Next, as shown in FIG. 5, the tool 100 is pressed into the metal tube 50 along the metal tube's longitudinal axis 55 so that the metal tube's 50 upper end 51 flares outwards as it makes contact with the transition location 114 of the flared end 110. As shown in FIG. 6, the tool 100 continues to press into the metal tube 50 along its 50 longitudinal axis 55 until the upper end 51 is flared so wide that it mechanically locks onto the return section 24 and the upper aperture 52, as shown in FIG. 6. If, as shown in FIG. 6, the upper end 51 is not entirely flush with the surface of the return section 24, the excess material 57 can be ground off in a subsequent step so that the upper end 51 is completely flush with the return section 24 as illustrated in FIG. 7.

This process is repeated for each of the upper and lower ends 51, 53 of each metal tube 50 so that all metal tubes 50 are mechanically locked to the golf club head 10 within the upper and lower apertures 52, 54. The seams 60 between each metal tube 50 and the golf club head 10 are then welded to conceal the seam and make the surface of the golf club head 10 easier to finish. The weld material may also cover the upper and lower ends 51, 53 of each metal tube 50 to prevent debris from entering the tubes 50 when the golf club head 10 is in use, or a cover (not shown) can be affixed to each upper and/or lower end 51, 53 via welding, adhesive, mechanical lock, or another means known to a person skilled in the art.

In each of the embodiments disclosed herein, the golf club head 10 preferably has a Characteristic Time (CT) of the face close to, but not exceeding, the 257 microsecond ("μS") limit set by the USGA. In any of the embodiments disclosed herein, when the golf club head 10 is designed as a driver, it preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. In fact, in the preferred embodiment, the golf club head 10 has a volume of approximately 450 cc to 460 cc.

The volume of the golf club head 10 will also vary between fairway woods (preferably ranging from 3-woods to eleven woods) with smaller volumes than drivers. When designed as a driver, the golf club head 10 preferably has a mass no more than 215 grams, and most preferably a mass of 180 to 215 grams; when designed as a fairway wood, the golf club head 10 preferably has a mass of 135 grams to 200 grams, and preferably from 140 grams to 165 grams.

In each of the embodiments disclosed herein, the face section 30 preferably has a varying thickness such as that described in U.S Pat. No. 7,448,960, for a Golf Club Head With Variable Face Thickness, which pertinent parts are hereby incorporated by reference.

Other alternative embodiments of the thickness of the face section 30 are disclosed in U.S Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the face section has a uniform thickness.

In each of the embodiments disclosed herein, the body 20 is preferably cast from molten metal in a method such as the well-known lost-wax casting method and the crown section 40 is composed of a carbon composite material. The metal for casting is preferably titanium or a titanium alloy such as 6-4 titanium alloy, alpha-beta titanium alloy or beta titanium alloy for forging, and 6-4 titanium for casting. Alternatively, the body 20 is composed of 17-4 steel alloy. Additional methods for manufacturing the body 20 include forming the body 20 from a flat sheet of metal, super-plastic forming the body from a flat sheet of metal, machining the body 20 from a solid block of metal, electrochemical milling the body 20 from a forged pre-form, casting the body 20 using centrifugal casting, casting the body 20 using levitation casting, and like manufacturing methods.

In other embodiments, the golf club head 10 may have a multi-material composition such as any of those disclosed in U.S. Pat. Nos. 6,244,976, 6,332,847, 6,386,990, 6,406,378, 6,440,008, 6,47,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,7490,96, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A wood-type golf club head comprising:

a cast metal body comprising a face section, a sole section, a return section, and an upper opening, the return section extending away from an upper edge of the face section and disposed between the face section and the upper opening;

a crown section disposed on the body to close the upper opening and define a hollow interior; and a plurality of metal tubes positioned within the hollow interior, each of the plurality of metal tubes extending from the return section to the sole section and positioned rearward from an interior surface of the face section a distance ranging from 2 millimeters to 11 millimeters, wherein the return section comprises a first plurality of apertures, wherein the sole section comprises a second plurality of apertures, wherein each of the first plurality of apertures corresponds to a metal tube of the plurality of metal tubes, wherein each of the second plurality of apertures corresponds to a metal tube of the plurality of metal tubes, wherein at least one of the metal tubes of the plurality of metal tubes is mechanically attached to the body, wherein at least one of the plurality of metal tubes has a flared upper end structure and a flared lower end structure.

2. The wood-type golf club head of claim 1, wherein each of the plurality of metal tubes is mechanically attached to the body.

3. The wood-type golf club head of claim 2, wherein each of the plurality of metal tubes has a flared upper end structure and a flared lower end structure.

4. The wood-type golf club head of claim 1, wherein each of the body and the plurality of metal tubes is composed of titanium alloy.

5. The wood-type golf club head of claim 1, wherein each of the plurality of metal tubes has a diameter ranging from 2 millimeters to 10 millimeters.

6. The wood-type golf club head of claim 5, wherein at least one of the plurality of metal tubes has a diameter of approximately 6 millimeters.

7. The wood-type golf club head of claim 1, wherein each of the plurality of metal tubes has a length ranging from 30 millimeters to 60 millimeters.

8. The wood-type golf club head of claim 1, wherein the crown section is composed of a carbon composite material, and wherein the body is composed of titanium alloy.

9. The wood-type golf club head of claim 1, wherein the plurality of metal tubes comprises three metal tubes, wherein each of the body and the three metal tubes is composed of titanium alloy, and wherein each of the three metal tubes has a flared upper end structure and a flared lower end structure.

10. The wood-type golf club head of claim 9, wherein the golf club head is a driver-type golf club head.

11. A method comprising the steps of:

casting from a metal material a golf club head body comprising a face section, a hollow interior, an upper opening, a return section comprising at least one upper aperture in communication with the hollow interior, and a sole section comprising at least one lower aperture in communication with the hollow interior, wherein the at least one upper aperture is vertically aligned with the at least one lower aperture;

providing at least one metal tube sized to fit within the at least one upper aperture and the at least one lower aperture, wherein the at least one metal tube comprises a longitudinal axis, a first end, and a second end;

inserting the at least one metal tube into the hollow interior via one of the at least one upper aperture and the at least one lower aperture so that the first end is disposed within the at least one upper aperture, the second end is disposed within the at least one lower aperture, and the metal tube is positioned rearward from an interior surface of the face section a distance ranging from 2 millimeters to 11 millimeters;

providing a tool having a flared tip;

inserting the flared tip into the first end of the at least one metal tube;

pressing the tool towards the hollow interior of the golf club head body along the longitudinal axis so that the first end is forced to flare outwards;

removing the flared tip from the first end of the at least one metal tube;

providing a composite crown section;

disposing the crown section over the upper opening of the golf club head body; and bonding the crown section to the golf club head body with an adhesive material, wherein the return section extends away from an upper edge of the face section and is disposed between the face section and the upper opening.

12. The method of claim 11, further comprising the step of covering the first end of the at least one metal tube with weld material.

13. The method of claim 11, wherein the at least one metal tube comprises first, second, and third metal tubes, wherein the at least one upper aperture comprises first, second, and third upper apertures, wherein the at least one lower aperture comprises first, second, and third lower aperture, wherein the first upper aperture is vertically aligned with the first lower aperture, wherein the second upper aperture is vertically aligned with the second lower aperture, and wherein the third upper aperture is vertically aligned with the third lower aperture.

* * * * *